US007036251B2

(12) United States Patent
Kojima et al.

(10) Patent No.: US 7,036,251 B2
(45) Date of Patent: May 2, 2006

(54) COUNTERWEIGHT MOUNTING STRUCTURE FOR CONSTRUCTION MACHINE

(75) Inventors: Kenta Kojima, Hiroshima (JP); Isao Miyachi, Hiroshima (JP); Yuichi Hoshino, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 127 days.

(21) Appl. No.: 10/778,033

(22) Filed: Feb. 17, 2004

(65) Prior Publication Data

US 2004/0200100 A1 Oct. 14, 2004

(30) Foreign Application Priority Data

Mar. 27, 2003 (JP) ..... 2003-087817

(51) Int. Cl.
*E02F 3/00* (2006.01)

(52) U.S. Cl. ..... 37/466; 414/602

(58) Field of Classification Search ..... 37/466, 37/443; 414/601, 602; 172/611, 776
See application file for complete search history.

(56) References Cited

U.S. PATENT DOCUMENTS 6,135,223 A * 10/2000 Miyachi et al. ..... 180/69.21
6,170,180 B1 * 1/2001 Schaeff ..... 37/443
6,601,324 B1 * 8/2003 Iwasa et al. ..... 37/347
2003/0056404 A1 * 3/2003 Iwasa et al. ..... 37/347

FOREIGN PATENT DOCUMENTS

| | | | |
|---|---|---|---|
| JP | 7-158466 | | 6/1995 |
| JP | 7-180184 | * | 7/1995 |
| JP | 9-189050 | | 7/1997 |
| JP | 9-209401 | | 8/1997 |
| JP | 11-256612 | * | 9/1999 |
| JP | 2001-348911 | | 12/2001 |

* cited by examiner

*Primary Examiner*—Victor Batson
(74) *Attorney, Agent, or Firm*—Oblon, Spivak, McClelland, Maier & Neustadt, P.C.

(57) ABSTRACT

A counterweight mounting structure for construction machine to which a counterweight is connected through a gap to an exterior constituting an upper rotating body is constituted such that a recessed groove is provided on an end on a connection side of the counterweight, an elastic soundproof material is installed in the recessed groove, and the soundproof material protruding from the recessed groove is brought in contact with, and pressed against an end on the connection side of the exterior when the counterweight is mounted. As a result, there is provided the counterweight mounting structure whose soundproof capability does not decrease even after the counterweight is mounted/dismounted.

7 Claims, 7 Drawing Sheets

COUNTERWEIGHT MOUNTING STRUCTURE FOR CONSTRUCTION MACHINE

BACKGROUND OF THE INVENTION

1. Field of the Invention

The present invention relates to a counterweight mounting structure for construction machine.

2. Description of the Related Art

A counterweight is mounted on an upper rotating body of a hydraulic excavator, and this counterweight is detachably mounted on a tail end section of a rotating frame of the upper rotating body using mounting bolts.

There is a gap between the tail end section of the rotating frame and the counterweight, and a sound insulation material made of a foamed urethane resin, for example, is disposed between the counterweight and the tail end section of the rotating frame for preventing noise or sound generated from an engine room from escaping through this gap to the outside. This insulation material is usually adhered to an upper surface of the tail end section of the rotating frame using a double stick tape.

It should be noted that a constitution which seals a gap between an exterior cover and a support member using a seal material in a mounting structure of an exterior cover of a construction machine is disclosed in Japanese Laid-Open Patent Publication (Kokai) No. H9-189050, although this constitution is not intended for a sound insulation.

The counterweight is usually dismounted for the maintenance of an engine and parts disposed around the engine, and this mount/dismount operation is frequently carried out.

During the mount/dismount operation including lift-up/down of the counterweight using a crane or the like, since the sound insulation material may be detached or damaged, there has been such a problem as a decrease of the sound insulation capability.

SUMMARY OF THE INVENTION

It is an object of the present invention to provide a counterweight mounting structure for construction machine whose soundproof capability does not decrease due to the mount/dismount operation of the counterweight.

The counterweight mounting structure for construction machine according to the present invention has the following principle constitution.

Namely, the counterweight mounting structure includes an upper rotating body rotatably mounted on a lower traveling body, a counterweight mounting member formed on the upper rotating body, and a counterweight connected to the counterweight mounting member through a fixing member with a predetermined gap, and the counterweight has a recessed portion along its mounting surface to the upper rotating body, namely a surface facing a tail end side of the upper rotating body. Further, an elastic soundproof member is installed on the counterweight in such a manner that a part of the soundproof member protrudes from an opening of the recessed portion. The soundproof member is brought in contact with, and pressed against an end surface of the counterweight mounting member from the outside in the state where the counterweight is mounted on the upper rotating body.

In this case, the soundproof member insulating the gap between the counterweight mounting member and the counterweight is installed in the recessed portion of the counterweight, and is pressed against the end surface of the counterweight mounting member, thereby insulating a propagation path of the noise or the sound from the engine room. As a result, even if a pulling force is applied to the soundproof member when the counterweight is mounted/dismounted, a detachment and a damage of the soundproof member is prevented, and even if a prying force is applied to the soundproof member, since most of the soundproof member is installed inside the recessed portion, the soundproof member is prevented from detaching. Therefore, according to the counterweight mounting structure of the present invention, decrease of the soundproof capability due to the mount/dismount operation of the counterweight can be prevented and good soundproofing capability can be maintained regardless of repeated mount/dismount operations of the counterweight.

DETAILED DESCRIPTION OF THE PREFERRED EMBODIMENTS

Description will now be given of a counterweight mounting structure for construction machine of the present invention with reference to FIGS. 1 through 8 according to respective embodiments.

Figure 1:
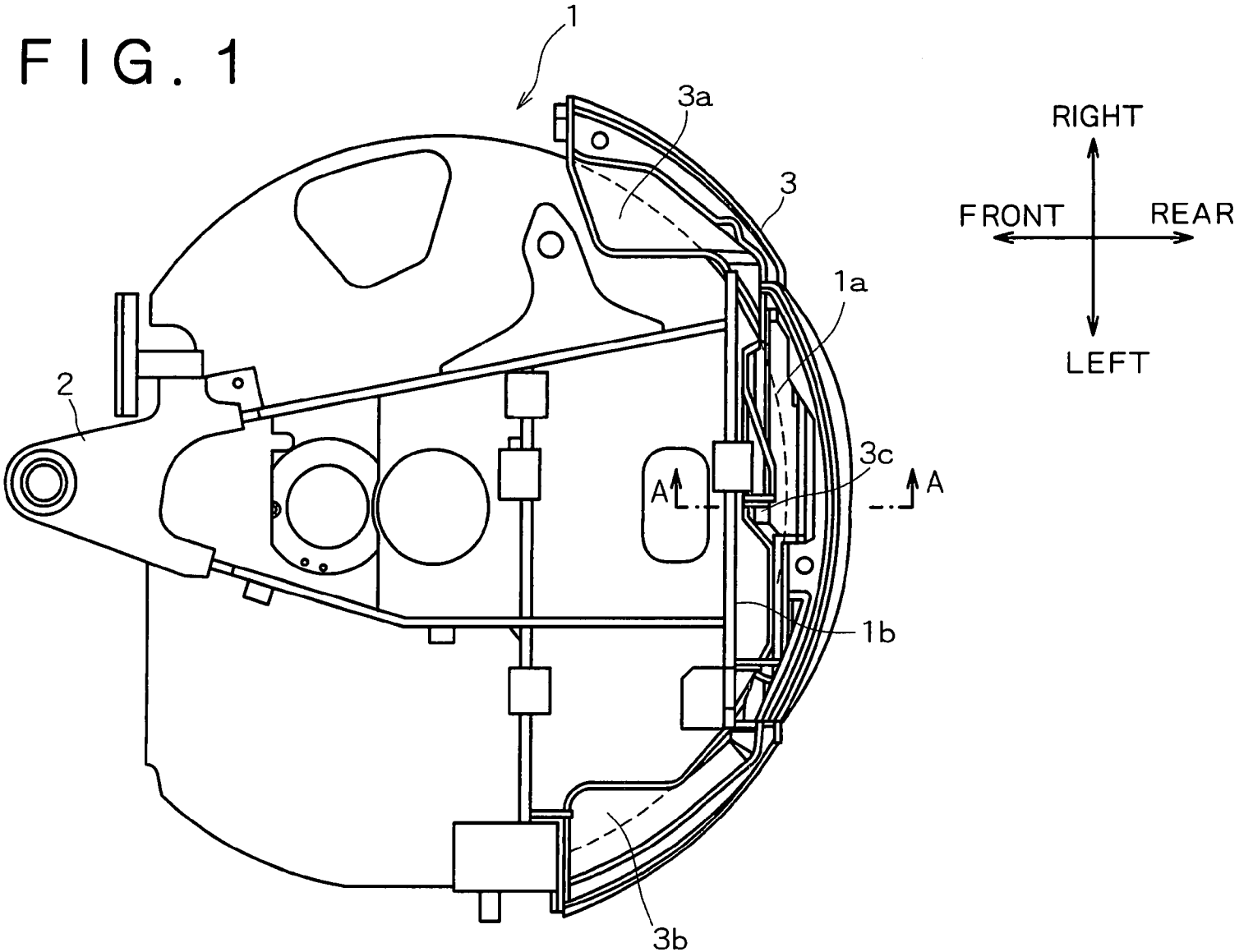
FIG. 1 is a plan view showing an arrangement of a counterweight and a rotating frame to which the present invention is applied.

The following description will be given of a hydraulic excavator as an example of the construction machine. The hydraulic excavator is constructed by rotatably installing an upper rotating body on a lower traveling body. A work attachment constituted by a bucket, an arm, and a boom is pivotally supported at a front section of the upper rotating body, and a counterweight is mounted on the tail or rear section of it. FIG. 1 is a plan view showing the arrangement of the counterweight and a rotating frame of the upper rotating body to which the present invention is applied.

The rotating frame 1 shown in FIG. 1 is used for an excavator with short tail swing radius, with zero tail swing overhang from crawlers, or with no overhang tail from the crawlers while the swing can be made the most of when used in a work site. A connection bracket 2 is protrudingly provided at the center on the front side of the rotating frame 1. A swing bracket (not shown) which can rotate about a vertical axis is attached to this bracket 2. Further, a work attachment (not shown) is provided on the swing bracket.

The tail end section 1*a* of the rotating frame 1 is formed in an arc shape so that the rotating radius of the tail section of the upper rotating body is fit within the vehicle width or machine body width. There is provided a counterweight 3 (sometimes simply abbreviated to CW hereinafter) formed in an arc shape along the tail end section 1*a*.

This CW3 is formed by casting, and there are provided fixing sections 3*a*, 3*b*, and 3*c* on both the left and right sides and approximately at the center for fixing the CW3 to the respective weight support seats as supporting base 4 of the rotating frame 1.

Figure 2:
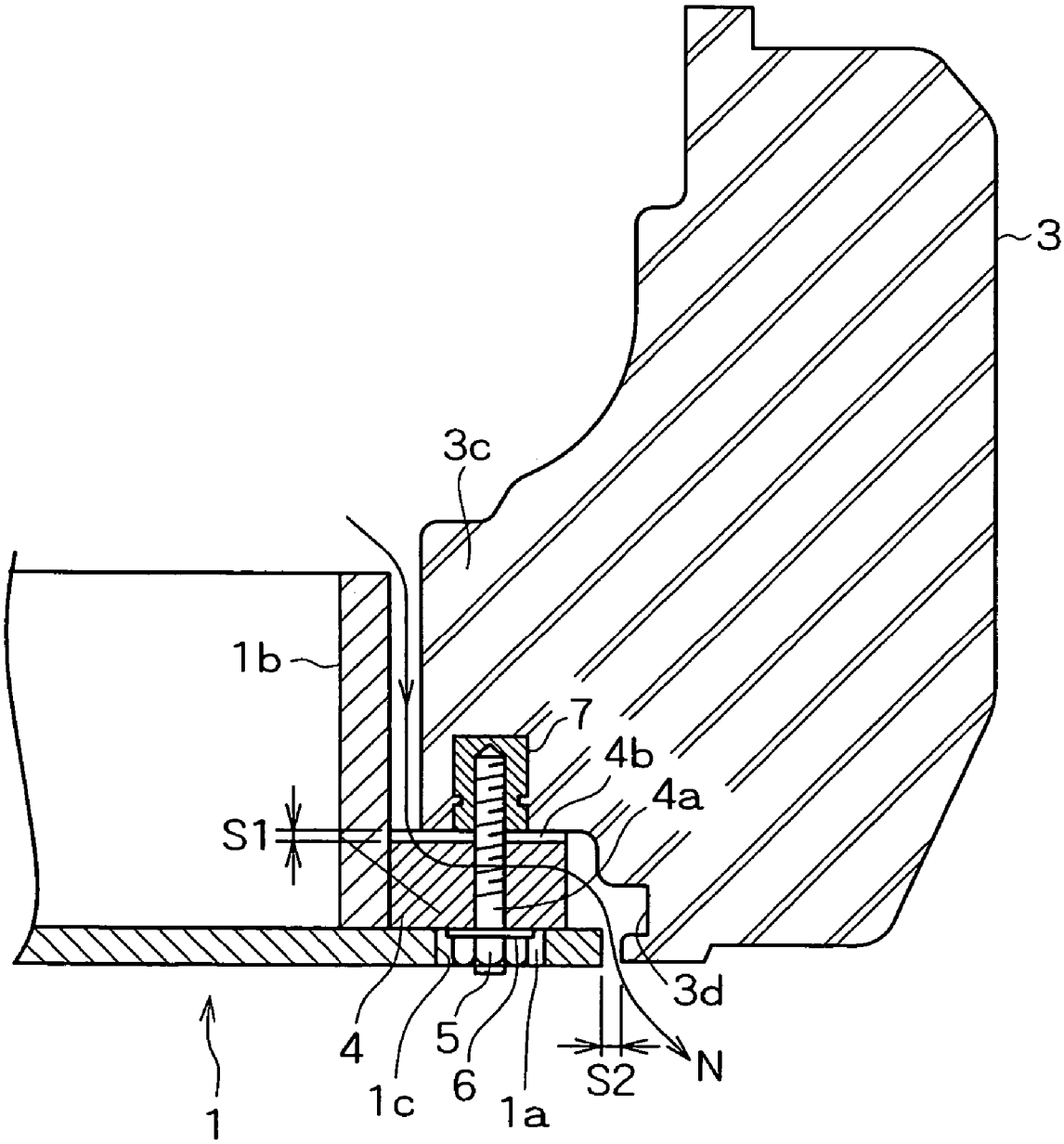
FIG. 2 is a cross sectional view made on a plane and in a direction indicated by arrows A in FIG. 1.

FIG. 2 is a cross sectional view made on a plane and in a direction indicated by arrows A in FIG. 1. In this view, three weight mounting bolts 5 are inserted from the bottom side of the rotating frame 1, pass through the respective weight support seats 4, and are threadedly engaged with the respective fixing sections 3*a*, 3*b*, and 3*c* (FIG. 2 shows only the fixing section 3*c*).

In more detail, the weight support seats 4 (sometimes abbreviated to as seats 4 hereinafter) are fixed to the tail end section (counterweight mounting member) 1*a* of the rotating frame 1. A through hole 4*a* is formed in the seat 4 for passing through the neck of the weight mounting bolt 5, and an opening 1*c* communicating with this through hole 4*a* is formed in the tail end section 1*a*. The opening 1*c* is formed as large as a washer 6 is loosely engaged.

A female thread section 7 is fixed to the fixing section 3*c* of the CW3 corresponding to the bolt 5. The bolt 5, the washer 6, and the female thread section 7 are only examples of a fixing member. The fixing members are not limited to the constitution of the present embodiment as long as the CW3 is connected to the weight support seats 4 through the fixing members while a predetermined gap is secured.

It should be noted that a shim 4*b* (gap adjusting member for adjusting the height) is inserted into a gap S1 between the bottom surface of the fixing section 3*c* and the upper surface of the weight support seat 4.

Reference numeral 1*b* denotes a guard plate erected on the rotating frame 1 in the view. An arrow N indicates a path along which noise or sound generated in an engine room and the like escapes to the outside when a soundproof member or sound arrester 8 which is applied according to the present invention is not provided. As described later, the path indicated by the arrow N is insulated by disposing the soundproof member 8 in a recessed groove 3*d* as recessed portion or concave portion.

Figure 3:
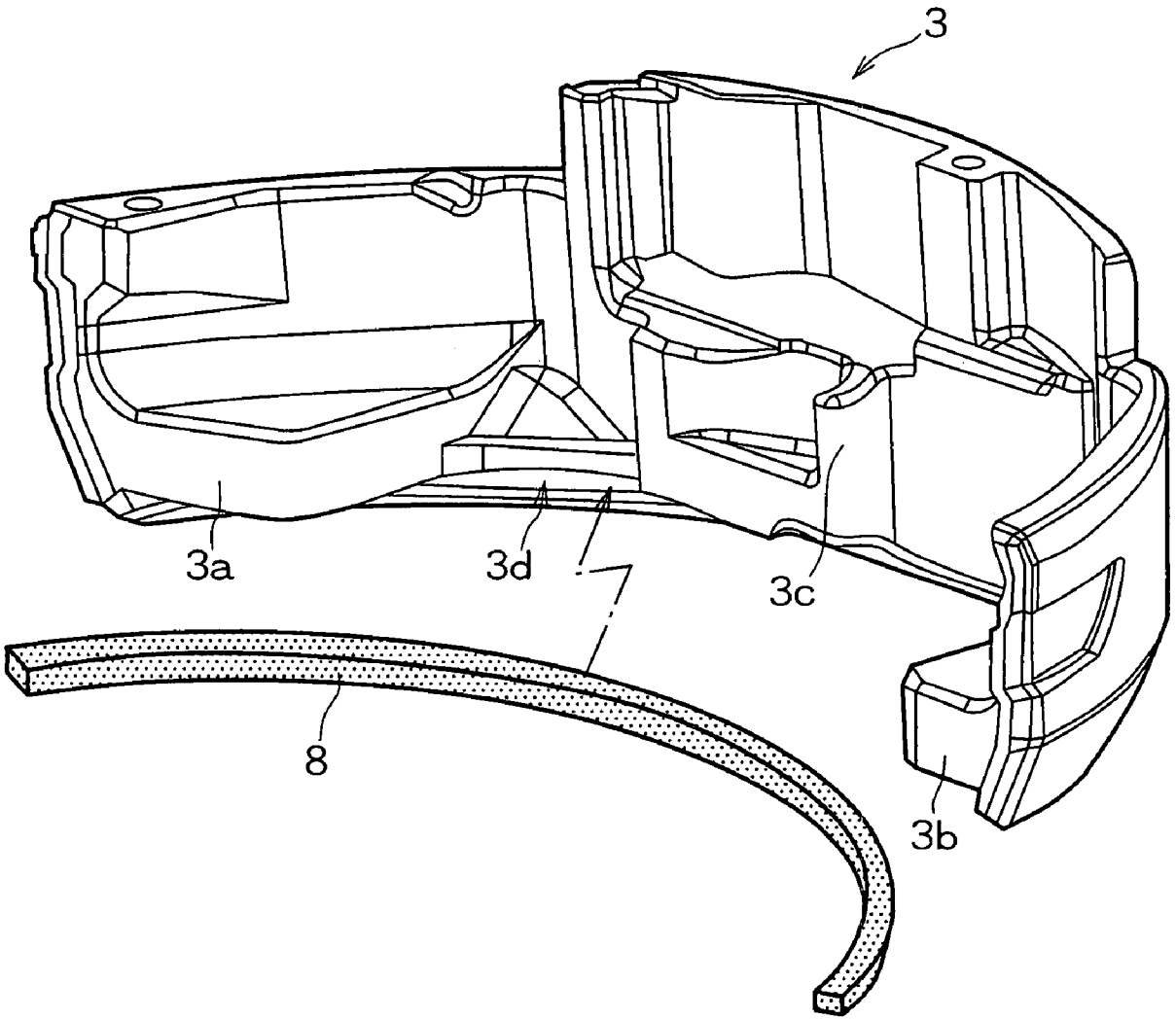
FIG. 3 is a perspective view showing a recessed groove formed on the counterweight in FIG. 1.

The recessed groove 3*d* is formed in an arc shape at a bottom part on the head side (the mounting surface) of the CW3 across the full width of the CW3 to prevent the escape of the noise as shown in FIG. 3 in the present embodiment. The elastic soundproof member 8 made of foamed urethane resin or glass wool, for example, formed into a belt shape is fit into this recessed groove 3*d*. The shape and the depth of this recessed groove 3*d* are arbitrary as long as the soundproof member 8 can be fit into it.

When the CW3 is connected to the tail end section 1*a* of the rotating frame 1 (serving as a counterweight mounting member) through the gap in this way, the recessed groove can be formed on the inner surface of the CW3 approximately horizontally facing the tail end section 1*a* of the rotating frame 1. In this case, excellent sound insulation capability is maintained even if a relatively large gap is present between the rotating frame 1 and the CW3.

Figure 4:
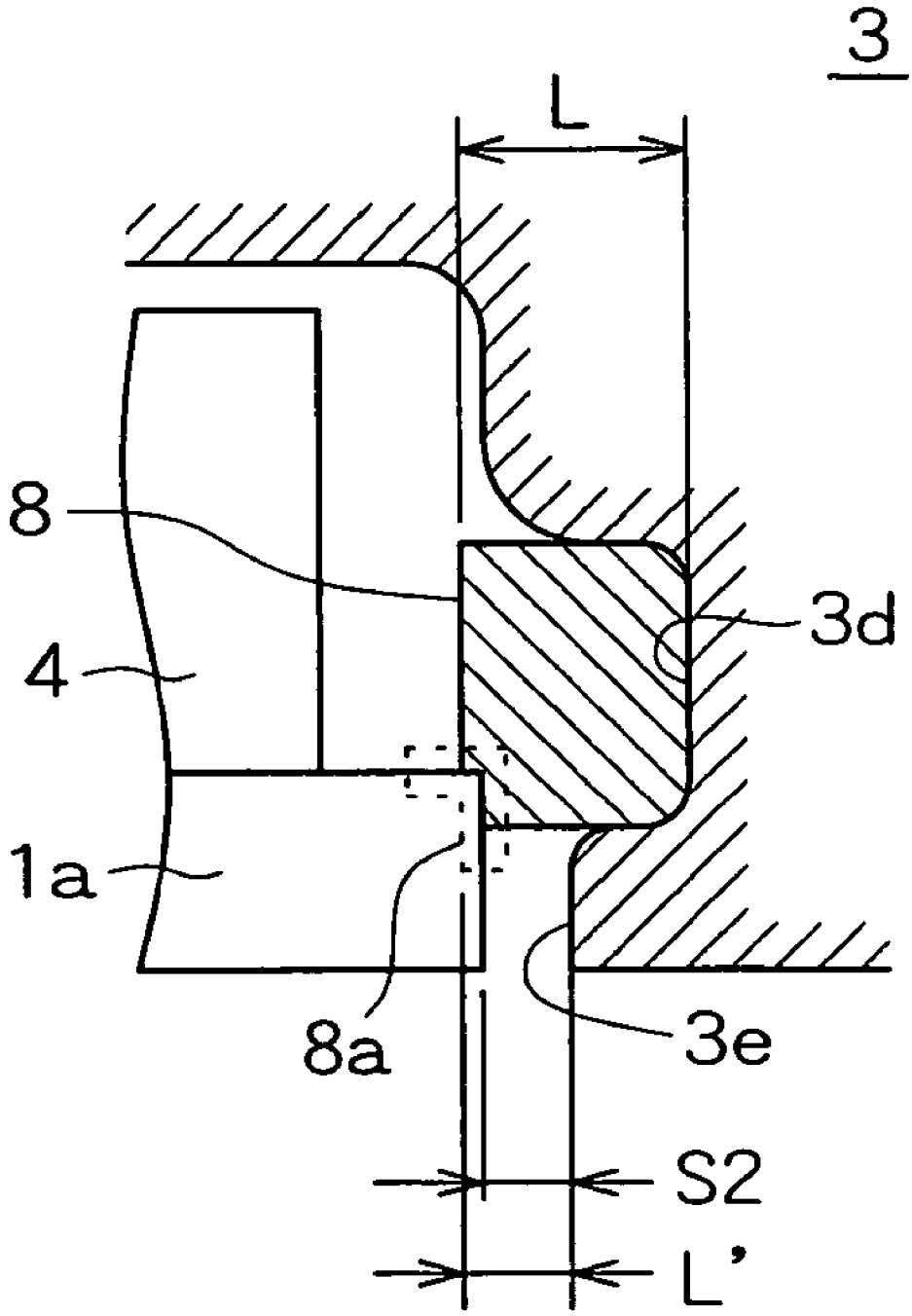
FIG. 4 is a cross sectional view showing a soundproof member installed in the recessed groove.

FIG. 4 shows an enlarged installation state of the soundproof member 8 to the recessed groove 3*d*.

The soundproof member 8 has a rectangular cross section. As shown in FIG. 4, when the soundproof member 8 in a compressed state is pressed into the recessed groove 3*d*, a part of the upper surface, the tail surface, and a part of the bottom surface are supported by the recessed groove 3*d*.

A protruded length from a bottom edge 3*e* of the recessed groove 3*d* is L' in the soundproof member 8, and a gap between the tail end section 1*a* of the rotating frame 1 and the bottom edge 3*e* is S2 when the CW3 is mounted. The length L of the soundproof member 8 in the head/tail direction is set in such a manner that L'>S2 in this state. Namely, this length L is set to such an extent that a part 8*a* of the head or front side surface of the soundproof member 8 is in contact with the tail end section (counterweight mounting member) 1*a* of the rotating frame 1, and, furthermore, is deformed by its compression arising from pressing against the tail end section 1*a*. Consequently, the noise propagation path N (see FIG. 2) can be insulated. In this view, the soundproof member 8 is in contact with an approximately vertical surface of the end surface of the tail end section 1*a* of the rotating frame 1.

It should be noted that if it is necessary to increase the contact area with the tail end section 1*a*, an auxiliary plate in an arc shape should be disposed on an upper surface of an edge of the tail end section 1*a*.

In this way, the soundproof member 8 is installed on the CW3 side by being fit into the recessed groove 3*d*. As a result, even if the CW3 is repeatedly mounted dismounted, the soundproof member 8 is protected by the recessed groove 3*d*, and thus is not damaged. Therefore, according to the counterweight mounting structure according to the present invention, it is possible to maintain the soundproof capability for a long period.

Figure 5:
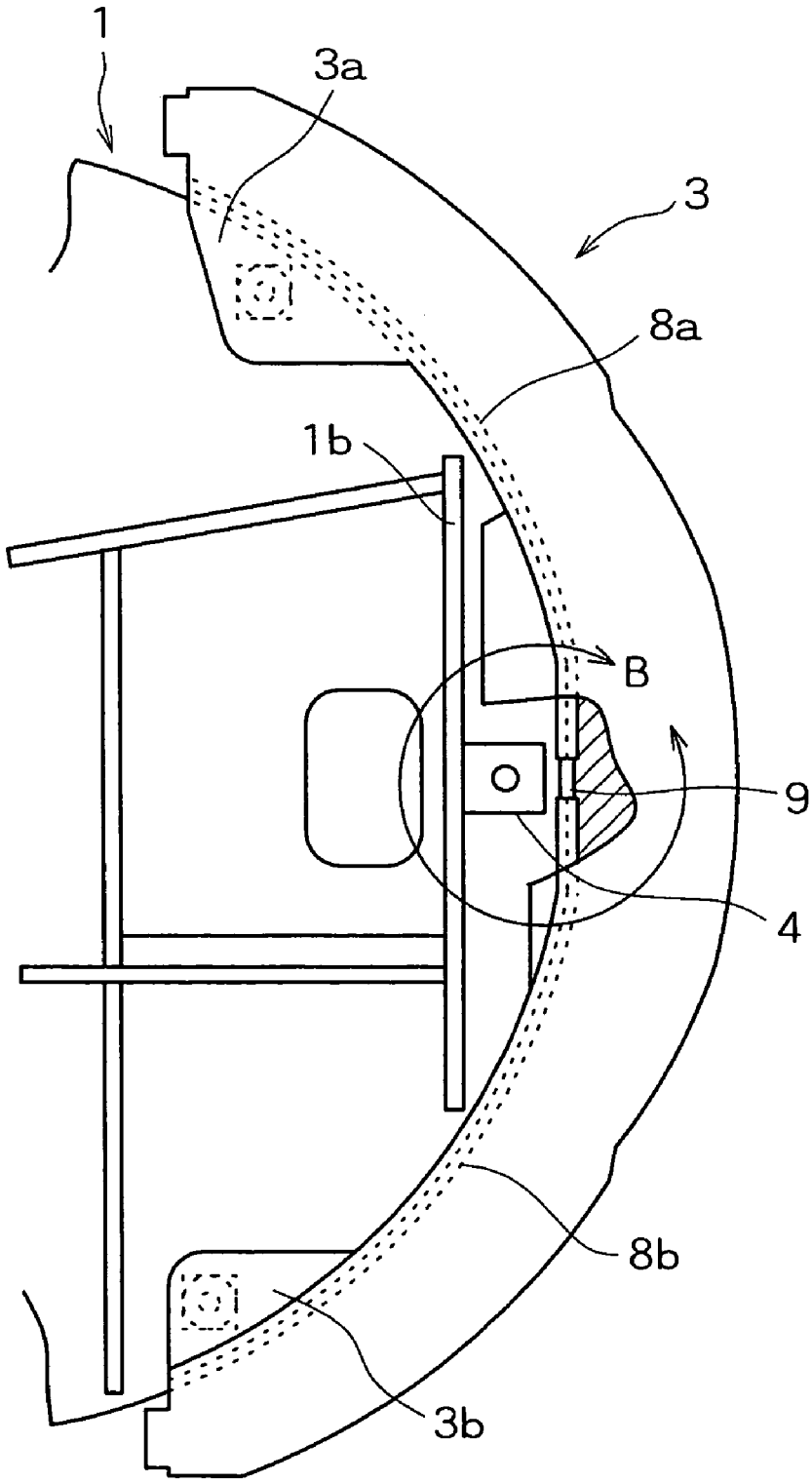
FIG. 5 is a plan view showing the counterweight mounting structure according to a second embodiment.

FIG. 5 shows a second embodiment of the counterweight mounting structure according to the present invention.

It should be noted that in FIG. 5, constitution elements identical to those in FIG. 1 and FIG. 2, which is an enlarged view of FIG. 1, are designated by identical reference numerals, and hence description thereof is omitted.

The constitution shown in FIG. 5 is different from that in FIG. 1 in a water drain or weep hole 9 disposed for discharging water.

If it is necessary to provide the water drain 9 in this way, a soundproof member 8*a* and a soundproof member 8*b* are disposed respectively on the left and right sides with the drain 9 as boundary. In this constitution, the soundproof members 8*a* and 8*b* are not present in the water drain 9. As a result, though the noise escapes to the outside through the water drain 9, the soundproof capability is secured by taking the following measures. Description will be given of this point.

Figure 6:
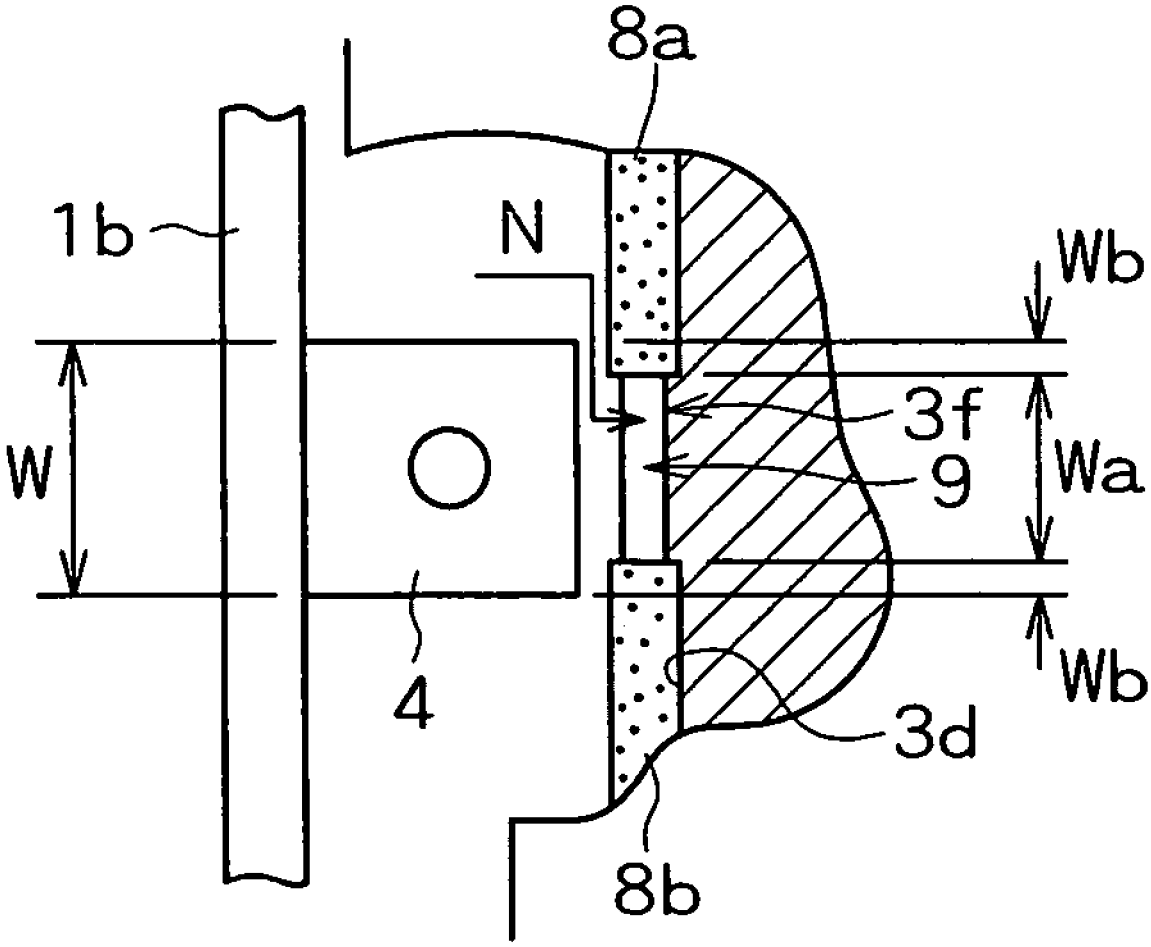
FIG. 6 is an enlarged view of a part B in FIG. 5.

FIG. 6 is an enlarged view of a part B in FIG. 5.

Figure 7:
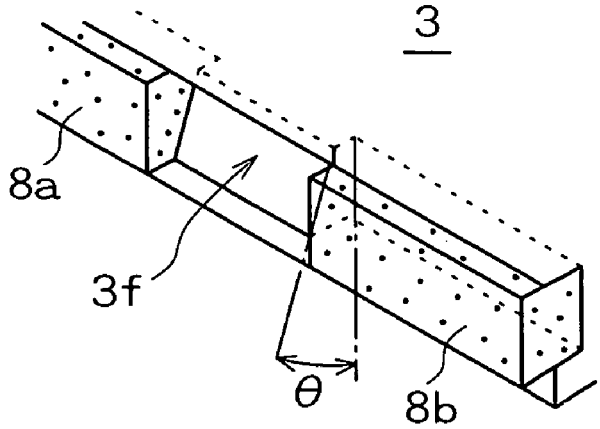
FIG. 7 is a perspective view showing the shape of a protrusion provided in the recessed groove.

As shown in this view, the relationship between the width W of the weight support seat 4 and the width Wa of the water drain 9 is constituted as W>Wa. Therefore, the extreme ends of the respective soundproof members 8*a* and 8*b* opposing to each other come into the water drain 9 toward its center by Wb on the both sides of a protrusion (partition or dividing portion) 3*f* formed slightly protruding toward the head side from the recessed groove 3*d*. This protrusion 3*f* is also constituted so as to function as a sound reflecting surface having an angle θ as shown in FIG. 7.

Further, the protrusion 3*f* functions as positioning means setting the positions of the extreme ends of the soundproof members 8*a* and 8*b* when the soundproof members 8*a* and 8*b* are installed into the recessed groove 3*d*.

Figure 8:
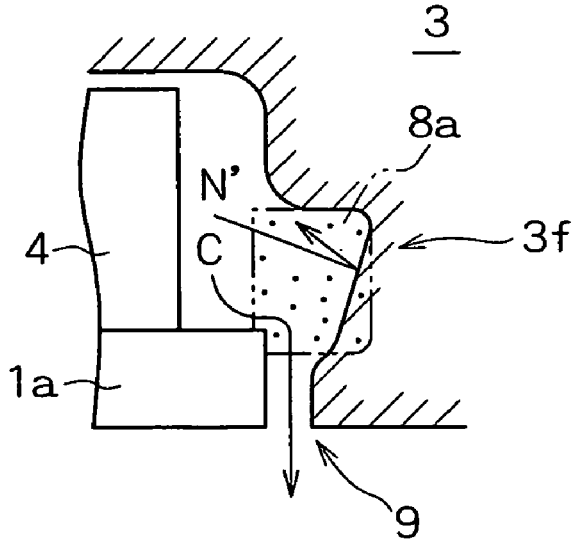
FIG. 8 is a cross sectional view showing the function of a water drain.

As an arrow C in FIG. 8 shows, water is easily discharged through the water drain 9. On the other hand, an arrow N' shows, the sound is reflected on the sound reflecting surface of the protrusion 3*f*, and thus does not directly pass through the water drain 9. This sound reflecting surface includes a tilted surface spreading out downward like an unfolded fan as shown in FIG. 8. As a result, the sound is reflected upward so that the sound does not pass along the path indicated by the arrow C. It should be noted that this tilted surface may not be straight, and may have a recessed shape as long as it is constituted to reflect the sound.

Since the recessed groove 3*d* has the protrusion 3*f* as the partition, the soundproof members 8*a* and 8*b* are provided as a plurality of divided parts with the protrusion 3*f* as boundary, and the water drain 9 is formed inside the protrusion 3*f*, excellent soundproof capability is maintained while the water drain capability is secured.

As the arrow N in FIG. 6 shows, the path to the water drain 9 is formed as a labyrinth structure (entangled path structure). A space including the water drain 9 has the labyrinth structure for damping sound escaping through the water drain 9 to the outside. As a result, the sound cannot pass directly through the water drain 9, and is damped in the process of collision with and subsequent detour around the soundproof members 8*a* and 8*b* and the like.

Even in a case where the water drain 9 is provided as in the second embodiment, since the damping means including the sound reflecting surface of the protrusion 3*f* and the labyrinth structure is provided, a remarkable soundproof effect is provided.

It should be noted that in the above-described embodiments, the description is given of the constitution examples of the soundproof in the gap between the tail end section 1*a* and CW3 when the counterweight mounting member is the rotating frame 1. The counterweight mounting structure according to the present invention is not limited to these examples, and may by applied to a case where the counterweight mounting structure is a body cover, and the sound passing through a gap between the body cover and the CW3 is insulated.

Although the invention has been described with reference to the preferred embodiments in the attached figures, it is noted that equivalents may be employed and substitutions made herein without departing from the scope of the invention as recited in the claims.

We claim:

1. A counterweight mounting structure for construction machine, the structure comprising:

an upper rotating body mounted rotatably on a lower traveling body;

a counterweight mounting member formed on said upper rotating body;

a counterweight connected to said counterweight mounting member through a fixing member with a predetermined gap, said counterweight having a recessed portion adjacent a surface thereof mounting said counterweight to said upper rotating body; and an elastic soundproof member installed on the counterweight in such a manner that a part of said soundproof member protrudes from an opening of said recessed portion, wherein said counterweight is mounted on said upper rotating body in such a way that said soundproof member is brought in contact with, and pressed against an end surface of said counterweight mounting member.

2. The counterweight mounting structure for construction machine according to claim 1, wherein said soundproof member is made contact with, and pressed against an approximately vertical surface of said counterweight mounting member from the outside.

3. The counterweight mounting structure for construction machine according to claim 1, wherein said counterweight mounting member is a tail end section of a rotating frame of said upper rotating body.

4. The counterweight mounting structure for construction machine according to claim 3, wherein said recessed portion is formed along an inner surface of said counterweight approximately horizontally facing the tail end section of said rotating frame.

5. The counterweight mounting structure for construction machine according to claim 1, wherein a dividing portion is formed in said recessed portion, said soundproof member is partitioned into a plurality of parts by said dividing portion as boundary, and a water drain is formed inside said dividing portion.

6. The counterweight mounting structure for construction machine according to claim 5, wherein said dividing portion of said recessed portion includes a sound reflecting surface spreading out downward like an unfolded fan.

7. The counterweight mounting structure for construction machine according to claim 5, wherein a space including the water drain has a labyrinth structure for damping sound escaping through said water drain to the outside.

* * * * *